United States Patent [19]

Trowsdale

[11] 4,361,192

[45] Nov. 30, 1982

[54] BOREHOLE SURVEY METHOD AND APPARATUS FOR DRILLING SUBSTANTIALLY HORIZONTAL BOREHOLES

[75] Inventor: Larry S. Trowsdale, Oklahoma City, Okla.

[73] Assignee: Kerr-McGee Corporation, Oklahoma City, Okla.

[21] Appl. No.: 119,745

[22] Filed: Feb. 8, 1980

[51] Int. Cl.[3] ..... E21B 7/00

[52] U.S. Cl. ..... 175/45; 33/302; 33/312; 33/313

[58] Field of Search ..... 33/302, 304, 312, 313, 33/301, 300; 175/45, 61, 62, 40; 324/247, 244, 259, 260

[56] References Cited

U.S. PATENT DOCUMENTS

| | | | |
|---|---|---|---|
| 2,500,267 | 3/1950 | Zublin | 175/107 X |
| 2,680,005 | 6/1954 | Storm | 175/256 |
| 3,285,629 | 11/1966 | Cullen et al. | 175/104 X |
| 3,380,543 | 4/1968 | Vincent | 175/73 |
| 3,563,323 | 2/1971 | Edgecombe | 175/107 X |
| 3,713,500 | 1/1973 | Russell | 175/94 X |
| 3,791,043 | 2/1974 | Russell | 33/312 |
| 3,807,502 | 4/1974 | Heilhecker et al. | 175/50 X |
| 3,823,787 | 7/1974 | Haworth et al. | 175/61 X |
| 3,862,499 | 1/1975 | Isham et al. | 33/302 X |
| 3,934,649 | 1/1976 | Pasini et al. | 299/12 X |
| 3,935,642 | 2/1976 | Russell | 33/302 |
| 4,043,395 | 8/1977 | Every et al. | 166/268 X |
| 4,051,456 | 9/1977 | Heilhecker et al. | 175/50 X |
| 4,143,721 | 3/1979 | Zuvela et al. | 175/45 |
| 4,153,110 | 5/1979 | Ridley | 166/259 X |
| 4,153,120 | 5/1979 | Zuvela et al. | 175/45 X |
| 4,196,781 | 4/1980 | Cheek | 175/45 |
| 4,273,193 | 6/1981 | Tompkins | 166/314 |

OTHER PUBLICATIONS

Report to the Department of Interior, Bureau of Mines "Advanced Techniques for Drilling . . ." vols. 1 and 2, Mar. 1973.

*Primary Examiner*—William D. Martin, Jr.
*Attorney, Agent, or Firm*—William G. Addison

[57] ABSTRACT

A borehole survey method and apparatus for use in drilling substantially horizontal boreholes through a mineral deposit wherein a dip accelerometer, a roll accelerometer assembly and a fluxgate are disposed near the drill bit, which is mounted on a bent sub, and connected to a surface computation and display unit by a cable which extends through the drill string. The dip angle of the borehole near the drill bit, the azimuth of the borehole near the drill bit and the roll angle or orientation of the bent sub are measured and selectively displayed at the surface while the drill string is in the borehole for utilization in guiding the drill bit through the mineral deposit along a predetermined path.

32 Claims, 9 Drawing Figures

BOREHOLE SURVEY METHOD AND APPARATUS FOR DRILLING SUBSTANTIALLY HORIZONTAL BOREHOLES

CROSS REFERENCE TO RELATED APPLICATIONS

The subject matter of the present invention is related to the copending applications entitled "Process for Degasification of Subterranean Mineral Deposits", Ser. No. 119,744 and "Process for Use in Degasification of Subterranean Mineral Deposits", Ser. No. 119,746 and now U.S. Pat. No. 4,273,193 which have been filed simultaneously with the filing of the present application and which are assigned to the assignee of the present invention.

BACKGROUND OF THE INVENTION

Field of the Invention

The present invention relates generally to borehole survey tools and, more particularly, but not by way of limitation, to a borehole survey method and apparatus for drilling substantially horizontal boreholes.

BRIEF DESCRIPTION OF THE DRAWINGS

FIG. 8 is a schematic view showing another portion of the surface computation and display unit of FIG. 1.

FIG. 9 is a schematic view showing one embodiment of the first and the second current limiters of FIG. 7.

BRIEF DESCRIPTION OF THE PREFERRED EMBODIMENTS

The present invention is particularly adapted for drilling relatively long and substantially horizontal boreholes. In mining underground coal or other mineral deposits containing gases, such as methane, for example, a plurality of horizontal boreholes are drilled through portions of the mineral deposit in a predetermined pattern to provide a controlled drainage of the gases from areas of the mineral deposit. The drilling of the horizontal boreholes or "degasification" boreholes, results in a relieving of the rock pressure in the mineral deposit caused by the presence of the gases, a minimizing of the probability of rock falls and a reducing of the possibility of gas explosions. It generally is desirable that the horizontal boreholes be formed along a predetermined path to create the desired pattern of boreholes and such boreholes preferably are in excees of 1,500 feet in length, the more desirable length being about 2,500 feet. The exact location of the drill bit must be determined during the drilling operations, so the drill bit can be guided through the mineral deposit along a predetermined path.

Figure 1:
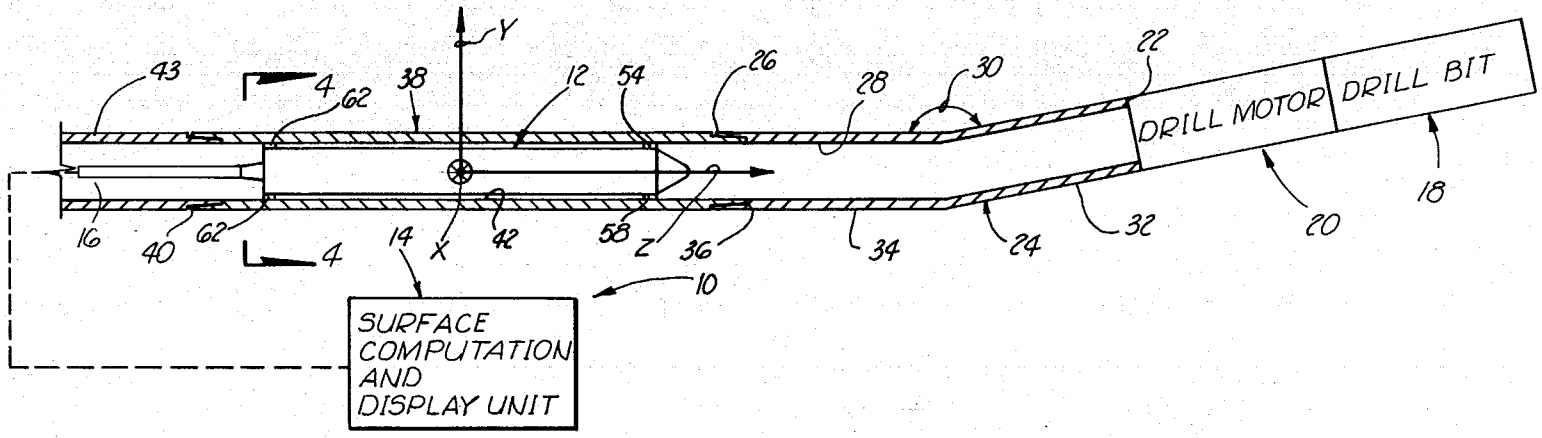
FIG. 1 is a diagrammatic, schematic view of the borehole survey apparatus of the present invention, showing the probe disposed within a portion of the probe housing, which is connected to the drill motor and drill bit.

Diagrammatically shown in FIG. 1 is a borehole survey apparatus 10 which is constructed to cooperate in guiding a drill bit through a mineral formation along a predetermined path. The borehole survey apparatus 10 generally consists of a probe 12 which is connected to a surface computation and display unit 14 via a cable 16. As shown in FIG. 1, a drill bit 18 is operatively connected to a drill motor 20, and the drill bit 18 and the drill motor 20 are connected to a leading end 22 of a bent sub 24. The bent sub 24 has an opposite trailing end 26 and an opening 28 extending therethrough intersecting the opposite ends 22 and 26 thereof. At a position spaced a distance from the leading end 22 of the bent sub 24, the bent sub 24 is bent at a predetermined angle 30 such that a bent portion 32 of the bent sub 24 extends at the angle 30 with respect to a remaining, straight portion 34 of the bent sub 24. In other words, the axial centerline of the bent portion 32 of the bent sub 24 extends at the angle 30 with respect to the axial centerline of the straight portion 34 of the bent sub 24. During the operation of drilling a horizontal borehole, the direction of movement of the drill bit 18 can be selectively changed by rotating the bent sub 24 generally about the axial centerline of the straight portion 34, thereby changing the orientation of the drill bit 18 with respect to the straight portion 34 of the bent sub 24. It should be noted that the angle 30 is exaggerated in FIG. 1 and, in one embodiment, the angle 30 was one hundred eighty degrees less zero degrees thirty minutes, for example.

The probe 12 includes instruments which are constructed and oriented to provide output signals indicative of the dip or inclination of the borehole generally near the location of the drill bit 18 in the borehole (the dip angle $\theta_D$), the azimuth or compass direction of the borehole generally near the location of the drill bit 18 in the borehole and the rotational orientation (roll angle $\theta_R$) of the drill bit 18. The signals indicative of the dip angle ($\theta_D$), the roll angle ($\theta_R$) and the azimuth are generated in the probe 12 and connected to the surface computation and display unit 14 via the cable 16, the surface computation and display unit 14 providing visually perceivable output indications indicative of the sensed or measured dip angle ($\theta_D$), roll angle ($\theta_R$) and the azimuth for use in guiding the drill bit 18 through the mineral formation along a predetermined path.

A leading end 36 of a probe housing 38 is connected to the trailing end 26 of the bent sub 24. The probe housing 38 also has a trailing end 40 and an opening 42 extending therethrough intersecting the opposite ends 36 and 40 thereof. In the connected position as shown in FIG. 1, the opening 42 through the probe housing 38 is axially aligned with the portion of the opening 28 extending through the straight portion 34 of the bent sub 24. The probe 12 is disposed within the opening 42 in probe housing 38 and positioned as near as possible to the trailing end 26 of the bent sub 24. It should be noted that, in some applications, the probe 12 may be supported within the opening 28 of the bent sub 24 and, in this instance, the portion of the bent sub 24 in which the probe 12 is disposed is referred to as the "probe housing". In any event, the probe 12 is positioned as near as possible to the drill bit 18.

During the mining operation a section of drill pipe 43 is connected to the trailing end 40 of the probe housing 38 and additional sections of drill pipe are added as the drill bit 18 is moved through the mineral deposit, the sections of drill pipe which are connected to the drill bit 18 collectively being referred to sometimes as a "drill string". It should be noted that in one embodiment, the probe housing 38 is one of the sections of drill pipe and thus constitutes a portion of the drill string.

A description of an apparatus for drilling horizontal boreholes, including a probe and means for assemblying the cable 16 in the drill string as sections of drill pipe were added, was included in the co-pending application entitled "Process for Degasification of Subterranean Mineral Deposits", referred to before, and the entire disclosure contained in that application specifically is incorporated herein by reference.

Figure 3:
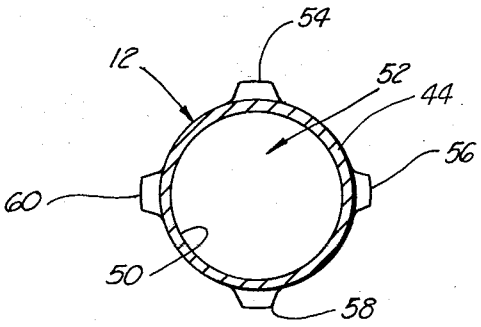
FIG. 3 is a sectional view taken substantially along the lines 3—3 of FIG. 2.
Figure 2:
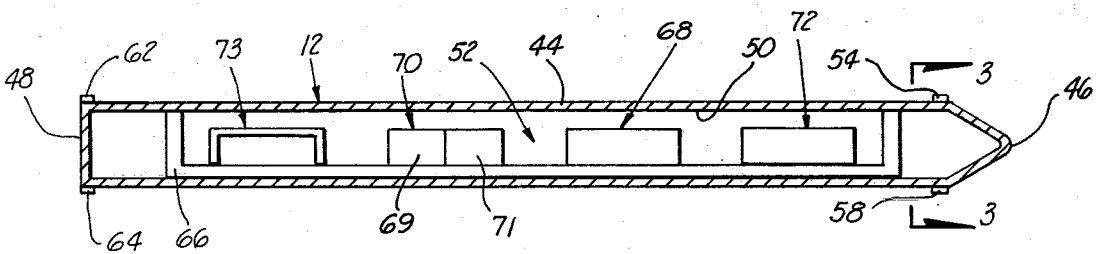
FIG. 2 is a cross sectional view showing a portion of the probe of FIG. 1.

As shown more clearly in FIGS. 2 and 3, the probe 12 includes an elongated, cylindrically shaped tube 44 having opposite ends 46 and 48 and an opening 50 which extends through a portion of the tube 44 thereby forming an enclosed space 52. A portion of the tube 44, generally near the end 46 thereof, is tapered to form a generally conically shaped end 46. The tube 44 is constructed of a non-ferro magnetic material, such as brass, for example, since instruments measuring components relative to the earth's magnetic field are supported within the tube 44.

During the mining operations, fluid is pumped through the drill string and through the openings 42 and 28 to the drill motor 20 for powering the drill motor 20 to rotatingly drive the drill bit 18. Four projections 54, 56, 58 and 60 are formed on the outer peripheral surface of the tube 44, near the end 46, each projection 54, 56, 58 and 60 extending a distance radially from the outer peripheral surface of the tube 44. The projections 54, 56, 58 and 60 are circumferentially spaced about the outer peripheral surface of the tube 44 such that, when the tube 44 is disposed within the opening 42 of the probe housing 38, spaces exist between the outer peripheral surface of the tube 44 to permit fluid to pass through the opening 42 generally between the probe housing 38 and the tube 44. Four additional projections are formed on the outer peripheral surface of the tube 44 generally near the end 48 (only two of the projections are shown in FIG. 2 and designated therein by the reference numerals 62 and 64). These four additional projections including the projections 62 and 64 are spaced on the tube 44 and function in a manner exactly like that described before with respect to the projections 54, 56, 58 and 60 for permitting fluid to pass through the opening 42 generally between the probe housing 38 and the tube 44.

As shown in FIG. 2, a support 66 is secured to the tube 44 and supported generally within a portion of the opening 50 in the tube 44. A dip accelerometer 68, a roll accelerometer assembly 70 and a fluxgate 72 are each secured to the support 66. A circuit board assembly 73 is secured to the support 66, the components of the circuit board assembly 73 being shown schematically in FIG. 6 connected to the dip accelerometer 68, the roll accelerometer assembly 70 and the fluxgate 72. The tube 44 is sealed in such a manner that the space 52 within the tube 44 forms a substantially fluid-tight compartment to protect the instruments and electrical circuits supported within the space 52.

Figure 4:
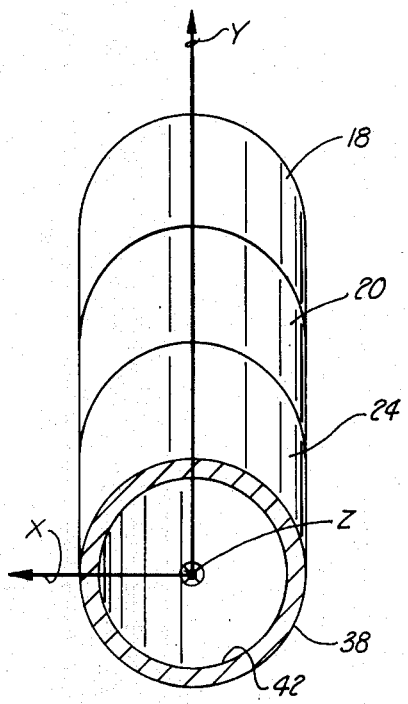
FIG. 4 is a sectional view taken substantially along the lines 4—4 of FIG. 1.
Figure 5:
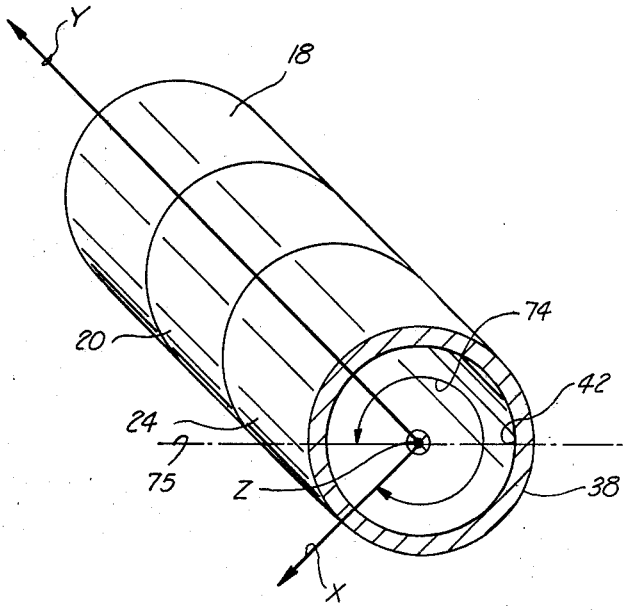
FIG. 5 is a sectional view similar to FIG. 4, but showing the bent sub rotated through a particular roll angle.

As shown in FIGS. 1, 4 and 5, a tool coordinate system initially is defined with a "z" axis extending generally along the axial centerline axis of the probe 12, an "x" axis extending generally perpendicular to the "z" axis and a "y" axis extending generally perpendicular to the "x" and the "z" axes. The probe 12 is oriented with respect to the probe housing 38 such that the "z" axis also substantially coincides with the centerline axis of the probe housing 38.

The roll angle ($\theta_R$) is the angle between a line 75 (shown in FIG. 5) extending parallel with respect to the earth's surface and the "x" axis. The orientation of the bent sub 24 with respect to the probe housing 38 initially is defined with respect to the tool coordinate system such that the roll angle ($\theta_R$) is zero degrees, an orientation shown in FIG. 4. In this initial position, the "y" axis lies in a plane which substantially coincides with the axial centerline axis of the bent portion 32 of the bent sub 24 with the bent portion 32 pointing in an upwardly direction, and the "x" axis extends in a horizontal direction with respect to the earth's surface. When it is desired to change the direction of movement of the drill bit 18 through the mineral deposit, the bent sub 24 is rotated through a predetermined roll angle ($\theta_R$) to change the orientation of the drill bit 18, the drill bit 18 being shown in FIG. 5 after the bent sub 24 has been rotated through the roll angle 74. Thus, the roll angle ($\theta_R$) indicates the position of the drill bit 18 relative to an initially established position of the drill bit 18 and is utilized to guide the drill bit 18 through the mineral deposit to form the borehole generally along a predetermined path.

The dip accelerometer 68 (shown in FIGS. 2 and 6) is constructed to sense or measure a component of acceleration due to gravity along some defined axis on the dip accelerometer and to provide an output signal which is indicative of the angle between the defined axis and the gravitational field strength. Accelerometers which are constructed to operate in a manner like that just described with respect to the dip accelerometer 68 are commercially available and, in one embodiment of the present invention, an accelerometer marketed by Schaevitz Engineering of Pennsauken, New Jersey and designated by the Model No. LSVP90 was found to operate in a satisfactory manner as the dip accelerometer 68.

The dip accelerometer 68 is supported within the probe 12 to measure a component of acceleration due to gravity along the "z" axis, the axial centerline axis of the probe 12, and the probe 12 is supported within the probe housing 38 such that the dip accelerometer 68 measures a compartment of acceleration due to gravity along the axial centerline axis of the probe housing 38. When the probe housing 38 is positioned within the borehole during the drilling operation, the probe 12 is positioned in the borehole generally near the drill bit 18 such that the dip accelerometer 68 measures a component of acceleration due to gravity along the axial centerline of the borehole at a position generally near the location of the drill bit 18 in the borehole and, in this instance, the dip accelerometer 68 provides an output signal on a signal path 76 (FIG. 6) indicative of the sine of the dip angle ($\sin \theta_D$), the angle between the centerline axis of the borehole and a line which is perpendicular to the gravitation field strength.

The roll accelerometer assembly 70 (shown in FIGS. 2 and 6) includes a first roll accelerometer and a second roll accelerometer 69 and 71, respectively. The first and the second roll accelerometers 69 and 71 are each constructed to measure a component of acceleration due to gravity along some defined axis on the accelerometer and to provide an output signal which is indicative of the angle between the defined axis and the gravitational field strength. Accelerometers which are commercially available from Schaevitz Engineering of Pennsauken, New Jersey and designated by the Model No. LSRP90 were found to operate satisfactory as the roll accelerometers 69 and 71.

The first roll accelerometer 69 is supported within the probe 12 to measure a component of acceleration due to gravity along the "y" axis. The probe 12 is supported in the probe housing 38 such that the first roll accelerometer 69 measures a component of acceleration due to gravity along an axis which extends generally perpendicular to the axial centerline axis of the probe housing 38, and the first roll accelerometer 69 provides an output signal on a signal path 78 (FIG. 6) which is indicative of the cosine of the roll angle ($\cos\theta_R$).

The second roll accelerometer 71 is supported within the probe 12 to measure a component of acceleration due to gravity along the "x" axis. The probe 12 is supported in the probe housing 38 such that the second roll accelerometer 71 measures a component of acceleration due to gravity along an axis of the probe housing 38 which extends generally perpendicular to the axial centerline axis of the probe housing 38, and the second roll accelerometer 71 provides an output signal on a signal path 80 (FIG. 6) which is indicative of the sine of the roll angle ($\sin\theta_R$). The output signals of the first and the second roll accelerometers are utilized to determine the roll angle ($\theta_R$), thereby providing an indication of the orientation of the drill bit 18 or, more particularly, the bent portion 32 of the bent sub 24 with respect to the probe housing 38 for directionally guiding the drill bit 18 in a predetermined path through the mineral deposit.

The fluxgate 72 is constructed to provide three output signals, each output signal being indicative of the relationship between a defined axis on the fluxgate 72 and the earth's magnetic field, the three output signals being indicative of the orientation of the fluxgate 72 with respect to a magnetic north vector. The fluxgate 72 is oriented in the probe 12 such that the fluxgate 72 coordinate system corresponds to the established tool coordinate system which comprises the "x", "y" and "z" axes.

The fluxgate 72 measures or senses a component of the earth's magnetic field strength measured along the "x" axis and provides a first output signal on a signal path 82 (FIG. 6) indicative of the measured or sensed component of the earth's magnetic field strength measured along the "x" axis, the fluxgate 72 measures or senses a component of the earth's magnetic field strength along the "z" axis and provides a second output signal on a signal path 86 indicative of the measured or sensed component of the earth's magnetic field strength measured along the "z" axis, and the fluxgate 72 measures or senses a component of the earth's magnetic field strength along the "y" axis and provides a third output signal on a signal path 84 (FIG. 6) indicative of the measured or sensed component of the earth's magnetic field strength measured along the "y" axis. The fluxgate 72 first and second output signals on the signal paths 82 and 86 are utilized to determine the azimuth or compass direction of the drill bit 18 moving through the borehole in a manner which will be described in greater detail below. Fluxgates which are constructed to operate in a manner like that just described with respect to the fluxgate 72 are commercially available from such sources as Schonstedt Instrument Company of Reston, Virginia, for example, and a fluxgate designated by the Schonstedt Model No. SAM-73C was found suitable for use in the present invention.

As mentioned before the components and networks shown in FIG. 6 are disposed within the probe 12 and connected to the surface computation and display unit 14 by the cable 16. The circuit board assembly 73 includes a relay 88. The relay 88 includes three switch arms 90, 92 and 94. Each of the switch arms 90, 92 and 94 is mechanically connected and the switch arms 90, 92 and 94 are operatively associated with an inductor 96. The switch arm 90 is connected to a panel switch assembly 98 (FIG. 7) by a signal path 100, the switch arm 92 is connected to the panel switch assembly 98 by a signal path 102 and the switch arm 94 is connected to the panel switch assembly 98 by a signal path 104.

The switch arm 90 has a dip position 106 wherein the switch arm 90 establishes electrical continuity between the dip accelerometer 68 and the panel switch assembly 98 via the signal paths 76 and 100, and an azimuth position 108 wherein the switch arm 90 establishes electrical continuity between the fluxgate 72 via the signal paths 82 and 100. The switch arm 92 has a roll position 110 wherein the switch arm 92 establishes electrical continuity between the first roll accelerometer 69 and the panel switch assembly 98 via the signal paths 78 and 102, and an azimuth position 112 wherein the switch arm 92 establishes electrical continuity between the fluxgate 72 and the panel switch assembly 98 via the signal paths 84 and 102. The switch arm 94 has a roll position 114 wherein the switch arm 94 establishes electrical continuity between the second roll accelerometer 71 and the panel switch assembly 98 via the signal paths 80 and 104, and an azimuth position 116 wherein the switch arm 94 establishes electrical continuity between the fluxgate 72 and panel switch assembly 98 via the signal paths 86 and 104.

Figure 6:
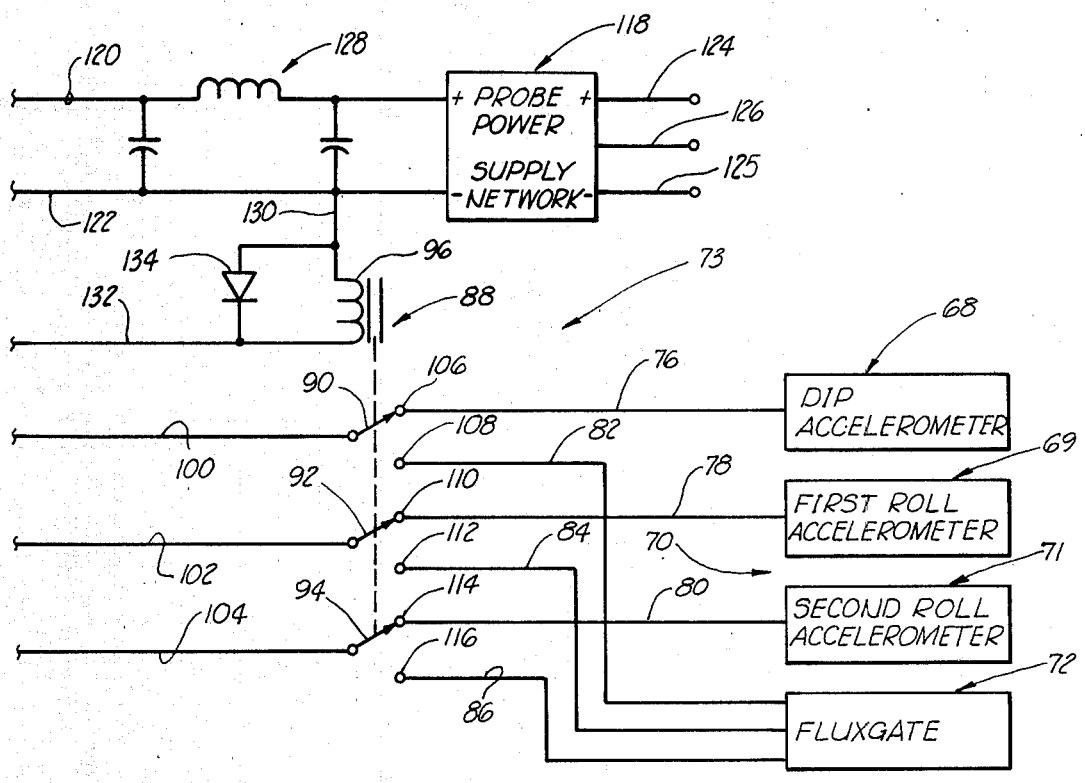
FIG. 6 is a schematic view showing the instruments and circuits disposed within the probe of FIGS. 1 and 2.

The relay 88 is shown in FIG. 6 in the de-energized state and, in this state, the switch arm 90 is in the dip position 106, the switch arm 92 is in the roll position 110 and the switch arm 94 is in the roll position 114. When power is applied to the inductor 96, the relay 88 is energized. In the energized state, the switch arm 90 is in the azimuth position 108, the switch arm 92 is in the azimuth position 112 and the switch arm 94 is in the azimuth position 116.

Figure 7:
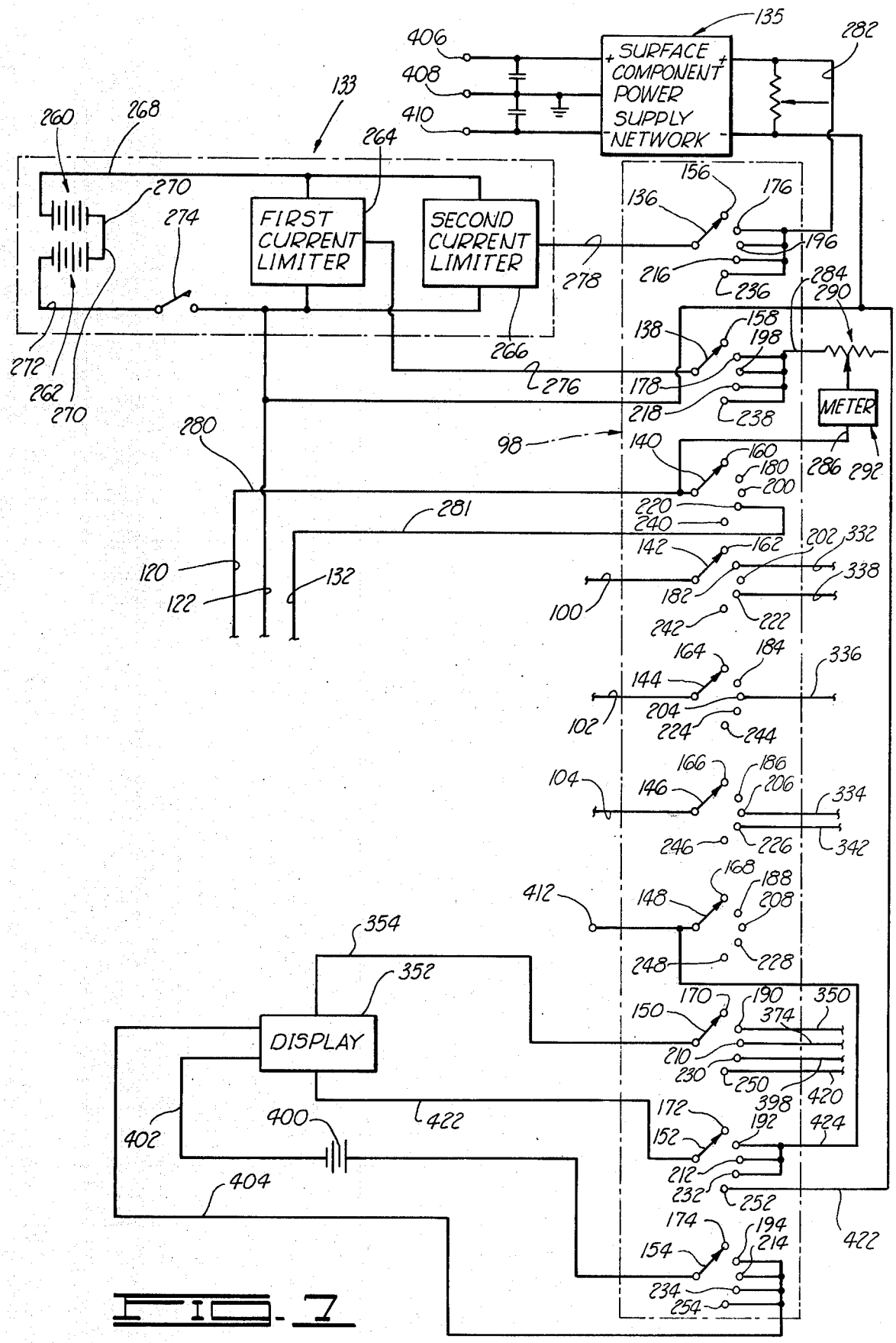
FIG. 7 is a schematic view showing a portion of the components of the surface computation and display unit of FIG. 1.
Figure 5:
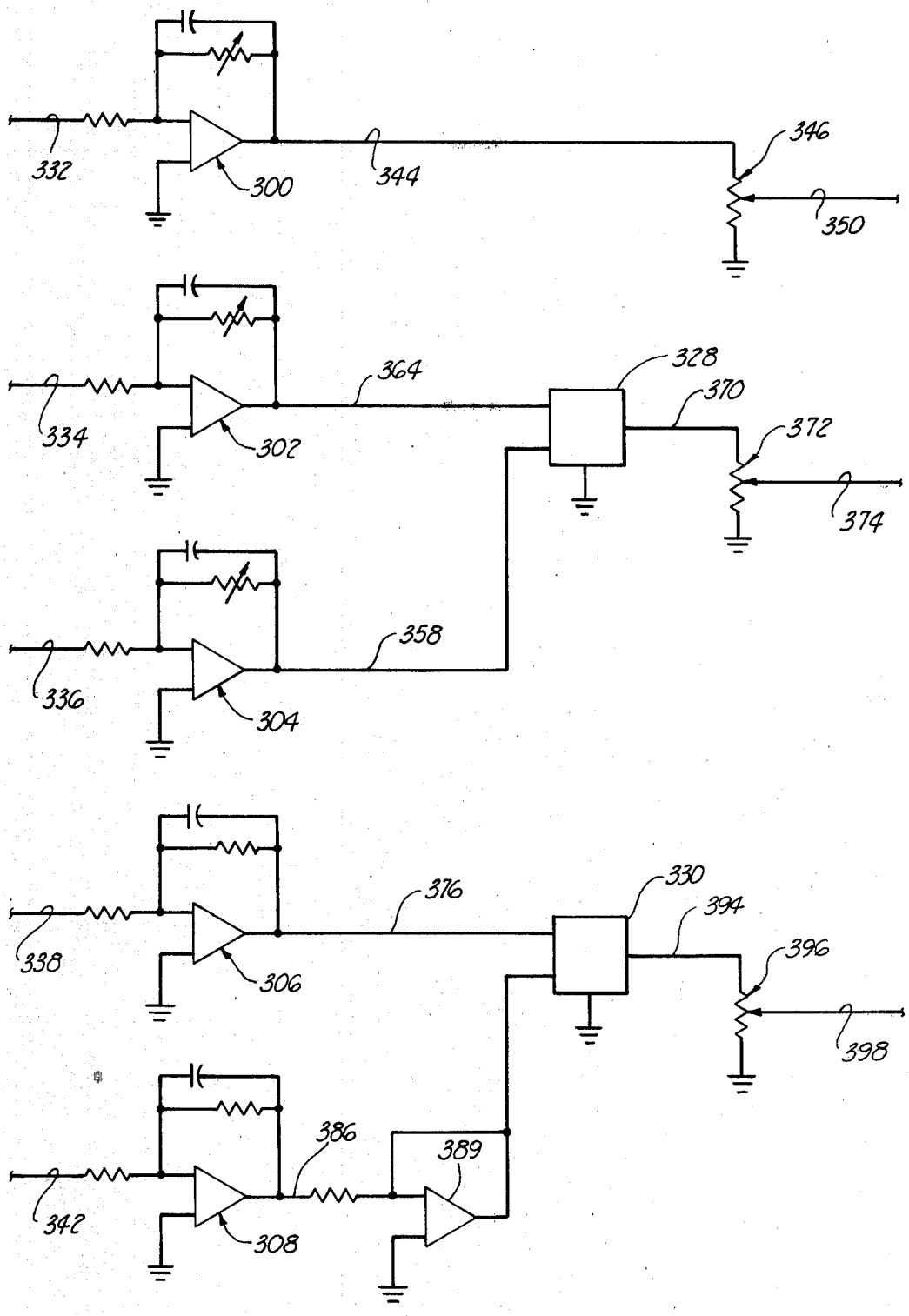
Figure 3:
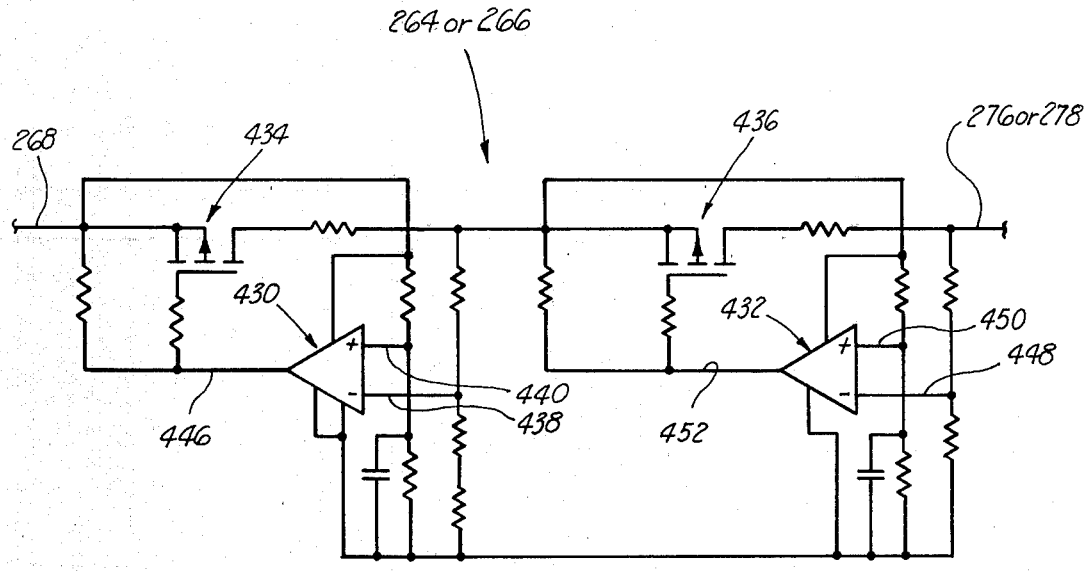

A probe power supply network 118 (FIG. 6) receives an electrical power signal via a pair of signal paths 120 and 122, the signal paths 120 and 122 being connected to the panel switch assembly 98 (FIG. 7). The probe power supply network 118 provides the electrical power via a pair of signal paths 124 and 125 for operating the dip accelerator 68, the first roll accelerator 69, the second roll accelerator 71 and the fluxgate 72, a conductor 126 providing an electrical common.

A filter 128 is interposed in the signal paths 120 and 122 for filtering the power signal to be received by the probe power supply network 118. In one embodiment, a twenty-four volt dc power signal is applied to the probe power supply network 118 on the signal paths 120 and 122 and the probe power supply 118 supplies a fifteen volt dc power signal on the signal paths 124 and 126.

The inductor 96 (FIG. 6) is connected to the negative signal path 122 via a signal path 130 and to the panel switch assembly 98 (FIG. 7) via the signal path 132. A diode 134 is connected in parallel with the inductor 96.

Shown in FIG. 7 is the panel switch assembly 98, a borehole survey apparatus power supply 133 which is the main power supply, and a surface component power supply network 135, all of the components being part of the surface computation and display unit 14 (FIG. 1).

The panel switch assembly 98 includes ten switch arms 136, 138, 140, 142, 144, 146, 148, 150, 152 and 154. The switch arms 136, 138, 140, 142, 144, 146, 148, 150, 152 and 154 are operatively connected for simultaneous movement to the various switch positions. The switch arms 136–154 each have an off position (designated respectively 156, 158, 160, 162, 164, 166, 168, 170, 172 and 174 in FIG. 7), a dip position (designated respectively 176, 178, 180, 182, 184, 186, 188, 190, 192 and 194), a roll position (designated respectively 196, 198, 200, 202, 204, 206, 208, 210, 212 and 214), an azimuth position (designated respectively 216, 218, 220, 222, 224, 226, 228, 230, 232 and 234) and a battery check position (designated respectively 236, 238, 240, 242, 244, 246, 248, 250, 252 and 254). The switch arms 136–154 are shown in FIG. 7 in the off positions.

The signal path 100 is connected to the switch arm 142. The signal path 102 is connected to the switch arm 144 and the signal path 104 is connected to the switch arm 146.

The borehole survey apparatus power supply 133 includes a pair of batteries 260 and 262. The positive terminal of the battery 260 is connected to the input of a first current limiter 264 and to the input of a second current limiter 266 via signal path 268. The negative terminal of the battery 260 is connected to the positive terminal of the battery 262 via a signal path 270. The signal path 270 provides the power ground conductor and the signal path 122 is connected to the power ground 270. The negative terminal of the battery 262 is connected to the ground terminals of the first and second current limiters 264 and 266 via a signal path 272 270.

A switch 274 is interposed in the signal path 272 and, in the opened position of the switch 274 as shown in FIG. 7, the batteries 260 and 262 are disconnected and electrical power is not supplied to the various components of the borehole survey apparatus 10. In the closed position of the switch 274, electrical power is supplied by the borehole survey apparatus power supply 133.

The output of the first current limiter 264 is connected to the switch arm 138 via a signal path 276 and the output of the second current limiter 266 is connected to the switch arm 136 via a signal path 278. A signal path 280 connects the switch arm 140 to the signal path 120 and a signal path 132 connects the signal path 281 to the azimuth position 220.

In one embodiment, the batteries 260 and 262 are twelve volt dc batteries. As shown in FIG. 7, the batteries 260 and 262 are connected in series to the first and the second current limiters 264 and 266 and the signal path 278 is the positive path of a twenty-four volt dc power supply, the signal path 276 also being the positive path of a twenty-four volt dc power supply.

The first and the second current limiters 264 and 266 each function to limit the maximum current of the power signal supplied at the output of the current limiters 264 and 266 on the signal paths 276 and 278. The first current limiter 264 operates to disconnect or interrupt electrical continuity between the batteries 260 and 262 and the signal path 276 when the current of the power signal supplied by the batteries 260 and 262 exceeds a predetermined maximum current level, the output of the first current limiter 264 supplying the electrical power to the probe 12. The second current limiter 266 operates to disconnect or interrupt electrical continuity between the batteries 260 and 262 and the signal path 278 when the current of the power signal supplied by the batteries 260 and 262 exceeds a predetermined maximum current level, the output of the second current limiter 266 supplying the electrical power to the surface component power supply network 135 when the switch arm 136 is positioned to establish electrical continuity between the second current limiter 266 and the surface component power supply network 135.

In the off position 156 of the switch arm 136, electrical power is not supplied to the surface component power supply network 135, since electrical continuity is interrupted between the borehole survey apparatus power supply 133 and the surface component power supply network 135 by the position of the switch arm 136. The dip position 176, the roll position 196, the azimuth position 216 and the battery check position 236 are each connected to the surface component power supply network 135 via a signal path 282. Thus, when the switch arm 136 is positioned in either the dip position 176 or the roll position 196 or the azimuth position 216 or the battery check position 236, the switch arm 136 functions to establish electrical continuity between the borehole survey apparatus power supply 133 and the surface component power supply network 135, the negative or ground terminal of the surface component power supply network 135 being connected to the conductor 272 via the switch 274.

In the off position 158 of the switch arm 138, electrical power is not supplied to the probe 12 or, more particularly, the probe power supply network 118, since electrical continuity is interrupted between the borehole survey apparatus power supply 133 and the probe power supply network 118 by the position of the switch arm 138. The dip position 178, the roll position 198, the azimuth position 218 and the battery check position 238 are each connected to the positive terminal of the probe power supply network 118 via a signal path 284, a signal path 286, the signal path 280 and the signal path 120, the signal path 122 connecting the probe power supply network 118 to conductor 272 via the switch 274. Thus, when the switch arm 138 is positioned in either the dip position 178, or the roll position 198 or the azimuth position 218 or the battery check position 238, the switch arm 138 functions to establish electrical continuity between the borehole survey apparatus power supply 133 and the probe power supply network 118.

A variable resistor 290 is interposed in the signal path 284 and a meter 292 is interposed in the signal path 286, the variable resistor 290 and the meter 292 both being interposed between the borehole survey apparatus power supply 133 and the probe power supply network 118. During the operation of the present invention, the length of the cable 16 increases as drill rod sections are added and the current of the power signal supplied to the probe power supply network 118 is controlled by varying the effective resistance of the variable resistor 290. In general, the effective resistance of the variable resistor 290 is decreased as drill rod sections are added or, in other words, as the length of the cable 16 is increased to control the current to maintain the current of the power signal supplied to the probe power supply network 118 below a predetermined maximum current level.

The switch arm 140 is interposed between the borehole survey apparatus power supply 133 and the relay 88 in the probe 12. The conductor 132 is connected to the azimuth position 220 via the signal path 281. In the off position 160, the dip position 180, the roll position 200 and the battery check position 240, the switch arm 140 functions to interrupt electrical continuity between the borehole survey apparatus power supply 133 and the relay 88, the relay 88 being de-energized in these positions of the switch arm 140. When the switch arm 140 is positioned in the azimuth position 220, electrical continuity is established between the borehole survey apparatus power supply 133 and the relay 88, thereby energizing the relay 88. In the energized state of the relay 88, the switch arm 90, 92 and 94 are each positioned in the azimuth position 108, 112 and 116, respectively.

As shown in FIG. 8, the surface computation and display unit 14 includes: a dip operational amplifier 300, a first roll operational amplifier 302, a second roll operational amplifier 304, a first azimuth operational amplifier 306, a second azimuth operational amplifier 308, a first angle converter 328 and a second angle converter 330.

The dip operational amplifier 300 (FIG. 8) is connected to the dip position 182 (FIG. 7) via a signal path 332. Thus, in the dip position 182 of the switch arm 142, electrical continuity is established between the dip operational amplifier 300 and the signal path 100. In the dip position 180, the relay 88 is de-energized and, thus, electrical continuity is established between the dip accelerometer 68 and the dip operational amplifier 300.

The first roll operational amplifier 302 (FIG. 8) is connected to the roll position 206 (FIG. 7) via a signal path 334. In the roll position 206 of the switch arm 146, electrical continuity is established between the first roll operational amplifier 302 and the second roll accelerometer 71 via the signal paths 334 and 104 and the switch arms 146 and 94, the relay 88 being de-energized.

The second roll operational amplifier 304 (FIG. 8) is connected to the roll position 204 (FIG. 7) via a signal path 336. In the roll position 204 of the switch arm 144, electrical continuity is established between the first roll accelerometer 69 and the second roll operational amplifier 304 via the signal paths 336 and 102 and the switch arms 144 and 92, the relay 88 being de-energized.

The first azimuth operational amplifier 306 (FIG. 8) is connected to the azimuth position 222 (FIG. 7) via a signal path 338. In the azimuth position 222 of the switch arm 142, electrical continuity is established between the first azimuth operational amplifier 306 and the fluxgate 72 via the signal paths 338, 100 and 82 and the switch arms 142 and 90, the relay 88 being energized.

The second operational amplifier 308 (FIG. 8) is connected to the azimuth position 226 (FIG. 7) via a signal path 342. In the azimuth position 226 of the switch arm 146, electrical continuity is established between the second azimuth operational amplifier 308 and the fluxgate 72 via the signal paths 342, 104 and 86 and the switch arms 146 and 94, the relay being energized.

In the dip positions of the switch arms 136–154, the dip operational amplifier 300 receives the dip accelerometer 68 output signal indicative of the sine of the dip angle (sin $\theta_D$), and provides an amplified output signal on a signal path 344 which is indicative of the sine of the dip angle ($\theta_D$). The dip operational amplifier 300 output signal is connected to a variable resistor 346 (FIG. 8) via the signal path 344 and the variable resistor 346 is connected to the dip position 190 (FIG. 7) via a signal path 350. In the dip position of the switch arms 136–154, the signal path 350 is connected to the input of a display 352 (FIG. 7) via a signal path 354 and the switch arm 150. The display 150 is constructed to receive the signal via the signal paths 344, 350 and 354 and to provide a visually perceivable output signal indicating the measured dip angle ($\theta_D$) expressed in terms of radians.

The dip accelerometer 68 measures a component of acceleration due to gravity along the "z" axis and provides an output signal indicative of this measured component. Prior to utilizing the probe 12, the variable resistor 346 is utilized to calibrate the surface computation and display unit 14 to provide the visually perceivable indication of the dip angle ($\theta_D$). The probe 12 is suspended in such a manner that the "z" axis is pointed directly downwardly and, with the probe 12 in this position, the variable resistor 346 is adjusted until the display 352 provides a visually perceivable output indicating the sine of the dip angle ($\theta_D$) is one (1.00). The dip accelerometer 68 provides an output signal which is proportional to the sine of the dip angle ($\theta_D$) and, by adjusting the variable resistor 346, the instruments are calibrated so that the dip accelerometer 68 output signal as displayed via the display unit 352 is equal to the sine of the dip angle ($\theta_D$).

The borehole survey apparatus 10 particularly is constructed for use in drilling relatively long; substantially horizontal boreholes, as mentioned before. In particular, it is contemplated that the dip angle ($\theta_D$) in actual practice will vary within a range of about plus three degrees (+3°) to about minus three degrees (−3°). For this relatively narrow range of dip angles ($\theta_D$) and considering the relatively small magnitude of the dip angles ($\theta_D$) within this range, the sine of the dip angle ($\theta_D$) is extremely close to the dip angle ($\theta_D$) expressed in radian measure. Thus, after calibration and, in the dip position of the switch arm 142, the display 352 will provide a visually perceivable output indication of the dip angle ($\theta_D$) expressed in radian measure. Since the probe 12 is disposed near the drill bit 18 and within the borehole, the display 352 provides a visually perceivable output indication of the dip angle ($\theta_D$) of the borehole at a position generally near the drill bit 18, during the drilling operations and in the dip position of the switch arm 142.

In the roll position of the switches 136–154, electrical continuity is interrupted between the relay 88 (FIG. 6) and the borehole survey apparatus power supply 133 (FIG. 7) by the open position of the switch arm 140, thereby de-energizing the relay 88 and positioning the switch arms 90, 92 and 94 in the positions 106, 110 and 114, respectively, as shown in FIG. 6. Further, in the roll position of the switches 136–154, electrical continuity is established between the second roll operational amplifier 304 and the first roll accelerometer 69 via the signal paths 336, 102 and 78 and the switch arms 144 and 92, and electrical continuity is established between the first roll operational amplifier 302 and the second roll accelerometer 71 via the signal paths 334, 104 and 80 and the switch arms 146 and 94. Electrical continuity is interrupted between the fluxgate 72 and the azimuth operational amplifiers 306 and 308 by the positioning of the switch arms 90, 92 and 94 (FIG. 6) and the positioning of the switch arms 142 and 146 (FIG. 7).

Thus, in the roll position of the switches 136–154, the second roll operational amplifier 304 (FIG. 8) receives the first roll accelerometer 69 output signal which is indicative of the cosine of the roll angle (cos $\theta_R$) and provides an amplified output signal on a signal path 358 which is indicative of the cosine of the roll angle (cos $\theta_R$). The second roll operational amplifier 304 output signal on the signal path 358 is connected to and received by the first angle converter 328.

In the roll position of the switches 136–154, the first roll operational amplifier 302 receives the second roll accelerometer 71 output signal which is indicative of the sine of the roll angle (sin $\theta_R$) and provides an amplified output signal on a signal path 364 which is indicative of the sine of the roll angle (sine $\theta_R$). The first roll operational amplifier 302 output signal on the signal path 364 is connected to and received by the first angle converter 328.

Thus, in the roll position of the switches 136–154, the first angle converter 328 receives one signal indicative of the sine of the roll angle (sin $\theta_R$) on a signal path 364 and another signal indicative of the cosine of the roll angle (cos $\theta_R$) on the signal path 358. The first angle converter 328 is constructed to determine the roll angle ($\theta_R$) expressed in radian measure in response to receiving the input signals indicative of the sine of the roll angle (sin $\theta_R$) and the cosine of the roll angle (cos $\theta_R$) and the first angle converter 328 provides an output signal on a signal path 370 indicative of the roll angle ($\theta_R$) expressed in radian measure.

The first angle converter 328 output signal on the signal path 370 is connected to a variable resistor 372 and the variable resistor 372 is connected to the roll position 210 via a signal path 374. In the roll position of the switch arms 136–154, the signal path 374 is connected to the input of the display 352 via the signal path 354 and the switch arm 150. The display 352 receives the signal via the signal paths 370, 374 and 354, which is indicative of the roll angle ($\theta_R$) expressed in radian measure and provides a visually perceivable output signal indicating the measured and determined roll angle ($\theta_R$) expressed in radian measure.

The first roll accelerometer 69 measures a component of acceleration due to gravity measured along the "y" axis and the second roll accelerometer 71 measures a component of acceleration due to gravity measured along the "x" axis. The first roll accelerometer 69 output signal is proportional to the measured component of acceleration due to gravity along the "y" axis and the second roll accelerometer 71 output signal is proportional to the measured component of acceleration due to gravity along the "x" axis.

The output signal provided by the first roll accelerometer 69 can be expressed as follows:

$$V_y=(c)\ (\cos\theta_R)\ (\cos\theta_D) \tag{1}$$

wherein:

$V_y$=the component of acceleration due to gravity along the "y" axis;

c=a constant;

$\theta_R$=the roll angle; and $\theta_D$=the dip angle.

The output signal provided by the second roll accelerometer 71 can be expressed as follows:

$$V_x=(c)\ (\sin\theta_R)\ (\cos\theta_D) \tag{2}$$

wherein:

$V_x$=the component of acceleration due to gravity along the "x" axis;

c=a constant;

$\theta_R$=the roll angle; and $\theta_D$=the dip angle.

It should be noted that the output signal provided by the first roll accelerometer 69 is a voltage which is proportional to the component of acceleration due to gravity along the "y" axis ($V_y$), and the output signal provided by the second roll accelerometer 71 is a voltage which is proportional to the component of acceleration due to gravity along the "x" axis ($V_x$). The constant "c" in the expressions (1) and (2) above is a constant which, in part, accounts for the fact that the output signals of the first and the second roll accelerometers 69 and 71 only are proportional to the actual components, the accelerometers 69 and 71 must be calibrated so the same proportionality constant "c" exists with respect to both the $V_x$ and the $V_y$ measurements, or the roll operational amplifiers 302 and 304 could be calibrated so the same proportionality constant "c" exists with respect to both the $V_x$ and the $V_y$ measurements or this calibration could be accomplished utilizing the variable resistor 372. Assuming the same proportionality constant "c" exists with respect to both the $V_x$ and the $V_y$ measurements, then:

$$\frac{V_x}{V_y}=\frac{(c)\ (\sin\theta_R)\ (\cos\theta_D)}{(c)\ (\cos\theta_R)\ (\cos\theta_D)} \tag{3}$$

The first and the second roll amplifiers 302 and 304 output signals are each received by the first angle converter 328. The first angle converter 328 operates to provide an output signal which is proportional to an angle whose tangent is the ratio of the input signals on the signal paths 364 and 358. Thus, the first angle converter 328 output signal on the signal path 370 is proportional to an angle whose tangent is the ratio of $V_x$ and $V_y$ as expressed below:

$$\alpha=\tan^{-1}\frac{V_x}{V_y} \tag{4}$$

wherein:

$\alpha$=the output signal of the first angle converter 328.

Substituting the expressions (2) and (3) above in the expression (4) above, the following expression is derived:

$$\alpha=\tan^{-1}\frac{(c)\ (\sin\theta_R)\ (\cos\theta_D)}{(c)\ (\cos\theta_R)\ (\cos\theta_D)} \tag{5}$$

Expression (5) above reduces to the following expression:

$$\alpha=\tan^{-1}\frac{\sin\theta_R}{\cos\theta_R} \tag{6}$$

The ratio of (sin $\theta_R$/cos $\theta_R$) in expression (6) above simply is the tangent $\theta_R$. By definition, the arc tangent of the tangent of an angle is the angle and thus expression (6) above reduces to the following expression:

$$\alpha=\theta_R \tag{7}$$

Thus, the output signal of the first angle converter 328 is proportional to the roll angle $\theta_R$. The output signal of the first angle converter 328 is connected to the input of the display 352 via the variable resistor 372, the signal path 374 and the switch arm 150 in the roll position of the switch arms 136–154. Thus, in the roll position of the switch arms 136–154, the display 352 will provide a visually perceivable output indication of the roll angle ($\theta_R$) expressed in radian measure. Knowing the roll angle ($\theta_R$), the operator can control the direction of drilling by orienting or positioning the bent sub 24.

In the azimuth position of the switch arms 136–154, the switch arm 140 establishes electrical continuity between the relay 88 and the downhole survey apparatus power supply 133, thereby energizing the relay 88 and positioning the switch arms 90, 92 and 94 in the positions 108, 112 and 116. In this position of the switch arms 90, 92 and 94, electrical continuity is interrupted between the dip accelerometer 68 and the dip operational amplifier 300, electrical continuity is interrupted between the first roll accelerometer 69 and the second roll operational amplifier 304, and electrical continuity is interrupted between the second roll accelerometer 71 and the first roll operational amplifier 302. In the azimuth position of the switch arms 136–154, electrical continuity is established between the fluxgate 72 output signal on the signal path 82 and the first azimuth operational amplifier 306, via the signal paths 82, 100 and 338 and the switch arms 142 and 90, electrical continuity is established between the fluxgate 72 output signal on the signal path 84 and the switch arm 144 via the signal paths 84, and 102 and the switch arm 92, and electrical continuity is established between the fluxgate 72 output signal on the signal path 86 and the second azimuth operational amplifier 308 via the signal paths 86, 104 and 342 and the switch arms 146 and 94.

Thus, in the azimuth position of the switch arms 136–154, the first output signal provided by the fluxgate 72 on the signal path 82, which is proportional to the component of the earth's magnetic field strength measured along the "x" axis, is received by the first azimuth operational amplifier 306 and the first azimuth operational amplifier 306 provides an amplified output signal on a signal path 376 which is proportional to the component of the earth's magnetic field strength measured along the "x" axis. The first azimuth operational amplifier 306 output signal is connected to and received by the second angle converter 330.

In the azimuth position of the switch arms 136–154, the third output signal provided by the fluxgate 72 on the signal path 84 which is proportional to the component of the earth's magnetic field strength measured along the "y" axis is connected to the switch arm 144 via the signal path 102. In this embodiment, the third output signal provided by the fluxgate 72 merely is provided at the surface for utilization if desired in some modified embodiment and the third output signal provided by the fluxgate 72 is not utilized.

In the azimuth position of the switch arms 136–154, the third output signal provided by the fluxgate 72 on the signal path 86 which is proportional to the component of the earth's magnetic field strength measured along the "z" axis is received by the second azimuth operational amplifier 308 and the second azimuth operational amplifier 308 provides an amplified output signal on a signal path 386 which is proportional to the component of the earth's magnetic field strength measured along the "z" axis. The second azimuth operational amplifier 308 output signal is connected to and received by the second angle converter 330, another operational amplifier 389 being interposed in the signal path 386 between the second azimuth operational amplifier 308 and the second angle converter 330.

The second angle converter 330 is constructed to provide an output signal on a signal path 394 indicative of the measured and determined azimuth or compass bearing in response to receiving the first and the second azimuth operational amplifiers 306 and 308 output signals. The second angle converter 330 output signal is connected to a variable resistor 396 and the variable resistor 396 is connected to the azimuth position 230 via a signal path 398. In the azimuth position of the switch arms 136–154, the second angle converter 330 output signal on the signal path 394 is connected to and received by the display 352 via the signal paths 394, 398 and 354 and the switch arm 150, and the display 352 is constructed to provide a visually perceivable output indication indicating the azimuth or compass bearing in response to receiving the second angle converter 330 output signal.

The first and the second azimuth operational amplifiers 306 and 308 output signals are each received by the second angle converter 330. The second angle converter 330 is constructed similar to the first angle converters 328 to provide an output signal which is proportional to an angle whose tangent is the ratio of the signals received by the second angle converter 330 on the signal paths 376 and 386.

The dip angle ($\theta_D$) will be relatively small and will be within a relatively narrow range of about plus three degrees ($+3°$) to about minus three degrees ($-3°$) as mentioned before, because the downhole survey apparatus 10 particularly is designed to be used in applications for drilling substantially horizontal boreholes. Some of the factors normally considered in determining the azimuth can be disregarded, because of the smallness of the dip angles ($\theta_D$). Further, if the probe 12 is rotated by rotating drill string to a position wherein the roll angle ($\theta_R$) is zero, other factors normally considered in determining the azimuth can be disregarded. Considering the smallness of the dip angle ($\theta_D$) and considering the roll angle ($\theta_R$) to be zero, the azimuth expressed in radian measure is approximately an angle whose tangent is the ratio of the component of the earth's magnetic field strength measured along the "x" axis to the component of the earth's magnetic field strength measured along the "z" axis or, in other words, the ratio of the input signals to the second angle converter 330 on the signal paths 376 and 386.

In one embodiment, it was found that, even though the dip angle ($\theta_D$) was relatively small, a more accurate indication of the azimuth was obtained when the probe 12 was positioned in the borehole such that the dip angle ($\theta_D$) was as near as possible to zero degrees. Thus, in this embodiment, the probe 12 was positioned in the borehole such that the roll angle ($\theta_R$) and the dip angle ($\theta_D$) each were zero degrees before obtaining the output indication of the azimuth. This mode of operation particularly is suited to the present invention since the probe 12 is constructed for use in drilling substantially horizontal boreholes.

Angle converters which are constructed to operate in the manner described above with respect to the angle converters 328 and 330 are commercially available from General Magnetics, Inc. of Bloomfield, New Jersey, for example.

A display unit power supply 400 is connected to the display unit 352 via a pair of conductors 402 and 404 for providing electrical operating power for the display unit 352. The switch arm 154 is interposed in the conductor 404 between the display unit power supply 400 and the display unit 352. In the off position 174 of the switch arm 154, electrical continuity is interrupted between the display unit power supply 400 and the display unit 352. The dip position 194, the roll position 214, the azimuth position 234 and the battery check position 254 are each connected to the conductor 404 and, in each of these positions 194, 214, 234 and 254, the switch arm 154 establishes electrical continuity between the display unit power supply 400 and the display unit 352.

The surface component power supply network 135 is connected to the borehole survey apparatus power supply 133 and provides an electrical power signal at output terminals 406, 408 and 410. In one embodiment, the borehole survey apparatus power supply 133 provides a twenty-four volt dc power signal and the surface component power supply network 135 provides a fifteen volt dc power signal for operating the various components shown in FIG. 8. A signal common ground is provided at a terminal 412, as shown in FIG. 7.

The battery check position 250 is connected to the batteries 260 and 262 via a signal path 420. In the battery check position 250 of the switch arm 150, electrical continuity is established between the batteries 260 and 262 and the display 352 via the signal paths 354 and 420 and the switch arm 150. The display 352 is connected to the conductor 272 via a signal path 422 and the switch arm 152 in the battery check position 252 of the switch arm 152 since the conductor 272 is connected to the battery check position 252. Thus, in the battery check positions 250 and 252 of the switch arms 150 and 152, respectively, the display 352 provides a visually perceivable output indication of the voltage being supplied by the batteries 260 and 262, thereby providing means for periodically checking the downhole survey apparatus power supply 133.

It should be noted that the dip position 192, the roll position 212 and the azimuth position 232 of the switch arm 152 are each connected to the signal common ground via a conductor 424. Thus, when the switch arms 136–154 are in the dip positions or the roll positions or the azimuth positions, the display 352 is connected to the signal common ground via the conductor 423, the switch arm 172 and the conductor 424, so the signals on the signal path 352 properly can be connected to and displayed by the display 352.

At any time during the drilling operations, the inclination or dip angle ($\theta_D$) of the borehole generally near the drill bit 18 is determined by positioning the switch arm 136–154 in the dip positions and, in the dip positions of the switch arms 136–154, a visually perceivable indication of the dip angle ($\theta_D$) expressed in radian measure of the borehole generally near the drill bit 18 is displayed by the display 352. A visually perceivable indication of the roll angle ($\theta_R$) expressed in radian measure is provided when the switch arms 136–154 are positioned in the roll positions. A visually perceivable indication of the azimuth or compass direction expressed in radian measure of the drill bit or, in other words, the azimuth of the borehole generally near the drill bit 18 is provided by the display 352 when the switch arms 136–154 are positioned in the azimuth positions and when the drill string has been rotated to a position wherein the roll angle ($\theta_R$) is zero.

The length of the borehole at any given time is known by the predetermined length of the drill rods which have been connected to form the drill string. By determining the length of the borehole, the dip angle ($\theta_D$) and the azimuth at periodic intervals during the drilling operations, the position of the borehole in the mineral formation can be plotted and, in addition, the position of the borehole in the mineral formation can be determined at any given time without removing the drill string from the borehole. From this information, if it is determined that the borehole is begining to deviate from a predetermined path, the direction of movement of the drill bit 18 through the mineral formation can be changed by rotating the probe housing 38 and the bent sub 24 through a predetermined angle, thereby changing the orientation of the drill bit 18. The orientation of the drill bit 18 at any given time is determined by the roll angle ($\theta_R$) and, thus, the orientation of the drill bit 18 can be controlled to maintain the movement of the drill bit 18 through the mineral formation along a predetermined path.

It should be noted that the fluxgate 72 output signals on the signal paths 82, 84 and 86 could be connected through switch arms to the azimuth operational amplifiers 306 and 308, thereby eliminating the relay 88 and associated circuitry. However, utilizing the relay 88 permits the accelerometers 68, 69 and 71 and the fluxgate 72 to be connected to the surface computation and display unit 14 with less conductors or signal paths, which reduces the number of conductors comprising the cable 16.

Embodiment of FIG. 9

The first and the second current limiters 264 and 266 are identical in construction and a schematic drawing of one typical current limiter 264 or 266 is shown in detail in FIG. 9. In general, each current limiter 264 or 266 includes a first and a second comparator circuit 430 and 432, respectively, and a first and a second switch 434 and 436, respectively. As shown in FIG. 9, the switches 434 and 436 are field effect transistors.

The positive terminal of the power supply or, more particularly, the batteries 260 and 262 are connected to the source terminal of the field effect transistors 434 and 436 via the signal path 268, and the signal path 276 or 278 is connected to the drain terminal of the field effect transistor 434 and 436. The gate terminal of the field effect transistor 434 is connected to the output terminal of the first comparator circuit 430 and the gate terminal of the field effect transistor 436 is connected to the output terminal of the second comparator circuit 432.

The power signal on the signal path 268 supplied by the batteries 260 and 262 is connected to one input terminal of the first comparator circuit 430 via a signal path 440 and a reference signal is applied to the other input terminal of the first comparator circuit 430 via a signal path 438.

The first comparator circuit 430 compares the power signal received on the input signal path 440 with the reference signal received on the input signal path 438 and provides an output signal in a "high" state on a signal path 446 in response to a comparison indicating that the current level of the power signal does not exceed or is lower than a predetermined maximum current level, the first comparator circuit 430 providing an output signal in the "low" state in response to a comparison indicating that the current level of the received power signal exceeds the predetermined maximum current level. The first comparator circuit 430 output signal is connected to the gate terminal of the field effect transistor 434. The field effect transistor 434 conducts current in response to receiving a "high" signal at the gate terminal and the field effect transistor 434 is in an "off"

or non-conducting state in response to receiving a "low" signal at the gate terminal. Thus, the field effect transistor 434 cooperates with the first comparator circuit 430 to interrupt electrical continuity between the batteries 260 and 262 and the output signal path 276 or 278 when the current level of the received power signal exceeds a predetermined maximum current level. The comparator circuits are connected in series and the first comparator circuit powers the second comparator circuit A power signal is connected to one input terminal of the second comparator circuit 432 via a signal path 450 and a reference signal is applied to the other input terminal of the second comparator circuit 432 via a signal path 448.

The second comparator circuit 432 compares the power signal received on the input signal path 450 with the reference signal received on the input signal path 448 and provides an output signal in a "high" state on a signal path 452 in response to a comparison indicating that the current level of the power signal does not exceed or is lower than a predetermined maximum current level, the second comparator circuit 432 providing an output signal in the "low" state in response to a comparison indicating that the current level of the received power signal exceeds the predetermined maximum current level. The second comparator circuit 432 output signal is connected to the gate terminal of the field effect transistor 436. The field effect transistor 436 conducts current in response to receiving a "high" signal at the gate terminal and the field effect transistor 436 is in an "off" or non-conducting state in response to receiving a "low" signal at the gate terminal. Thus, the field effect transistor 436 cooperates with the second comparator circuit 432 to interrupt electrical continuity between the batteries 260 and 262 and the output signal path 276 or 278 when the current level of the received power signal exceeds a predetermined maximum current level.

It should be noted that the current limiter 264 or 266 would operate in the described manner to disconnect the power signal supplied by the batteries 260 and 262 if the second comparator circuit 432 and the second field effect transistor were eliminated. However, a dual network has been provided for safety reasons in the event one of the components malfunctions.

Changes may be made in the construction or operation of the various components or assemblies described herein and changes may be made in the steps or in the sequence of the steps of the method described herein without departing from the spirit and the scope of the invention as defined in the following claims.

What is claimed is:

1. An apparatus adapted for drilling substantially horizontal boreholes through an earth formation, comprising:

a drill bit;

a drill motor operatively connected to the drill bit for driving the drill bit to form the borehole through the earth formation;

a probe housing, the drill motor and the drill bit being connected to one end of the probe housing;

a probe supported within the probe housing and disposed near the drill bit;

means for measuring the components of the earth's magnetic field along a preselected "x" axis extending perpendicularly to the axial centerline of the probe and along a "z" axis extending along the axial centerline of the probe and providing an output indication of the azimuth of the borehole from the "z" component of the earth's magnetic field and the "x" component of the earth's magnetic field when the "x" axis is disposed in a horizontal plane, comprising:

a fluxgate supported in the probe for measuring the component of the earth's magnetic field strength along the "x" axis and providing a first output signal proportional to the measured component of the earth's magnetic field strength generally along the "x" axis, and for measuring a component of the earth's magnetic field strength generally along the "z" axis and providing a second output signal proportional to the measured component of the earth's magnetic field strength generally along the "z" axis;

an angle converter receiving the first and second output signals provided by the fluxgate and providing an output signal proportional to an angle whose tangent is the quotient of the first and second output signals provided by the fluxgate, the angle converter output signal being proportional to the azimuth of the probe housing; and means for receiving the output signal provided by the angle converter and providing an output indication of the azimuth of the probe housing.

2. The apparatus of claim 1 defined further to include: a bent sub having a leading end and a trailing end and being interposed between the probe housing and the drill motor and drill bit, the trailing end being connected to one end of the probe housing and the drill motor being connected to the leading end, a portion of the bent sub extending at a predetermined angle with respect to the remaining portion of the bent sub.

3. The apparatus of claim 1 defined further to include:

means supported in the probe for measuring the dip angle ($\theta_D$) of the borehole and providing an output signal indicative of the measured dip of the borehole at a position generally near the drill bit;

means supported in the probe for measuring the rotational orientation, the roll angle ($\theta_R$), of the drill bit relative to a predetermined rotational orientation of the drill bit and providing an output signal indicative of the roll angle ($\theta_R$); and means located remotely with respect to the probe for receiving the signal indicative of the dip angle ($\theta_D$) and for receiving the signal indicative of the measured azimuth and for receiving the signal indicative of the roll angle ($\theta_R$), and for providing visually perceivable output indications of the measured dip angle ($\theta_D$), the measured azimuth and the measured roll angle ($\theta_R$).

4. The apparatus of claim 1 further defined to include means supported in the probe for measuring the rotational orientation, the roll angle ($\theta_R$), of the drill bit relative to a predetermined rotational orientation of the drill bit and providing an output signal indicative of the roll angle ($\theta_R$) comprising:

a first roll accelerometer for measuring a component of acceleration due to gravity along a "y" axis disposed perpendicularly to the "x" and "z" axes and providing an output signal proportional to the measured component of acceleration due to gravity along the "y" axis; and a second roll accelerometer for measuring a component of acceleration due to gravity along the "x" axis and providing an output signal proportional to the measured component of acceleration due to gravity along the "x" axis.

5. The apparatus of claim 4 wherein the first roll accelerometer is defined further as being supported in the probe to provide an output signal proportional to the cosine of the roll angle ($\theta_R$), and wherein the second roll accelerometer is defined further as being supported in the probe to provide an output signal proportional to the sine of the roll angle ($\theta_R$).

6. The apparatus of claim 5 defined further to include:

means located remotely with respect to the probe for receiving the first accelerometer output signal and the second accelerometer output signal and providing an output signal indicative of the roll angle ($\theta_R$).

7. The apparatus of claim 6 wherein the means for receiving the output signal provided by the first and the second accelerometers is defined further to include:

a first roll operational amplifier receiving the first roll accelerometer output signal and providing an amplified output signal proportional to the sine of the roll angle ($\theta_R$);

a second roll operational amplifier receiving the output signal provided by the second roll accelerometer and providing an amplified output signal indicative of the cosine of the roll angle ($\theta_R$); and an angle converter receiving the first roll operational amplifier output signal and the second roll operational amplifier output signal and providing an output signal indicative of the roll angle ($\theta_R$).

8. The apparatus of claim 7 wherein the means for providing an output signal indicative of the roll angle ($\theta_R$) is defined further as providing a visually perceivable output signal indicative of the roll angle ($\theta_R$).

9. The apparatus of claim 7 wherein the angle converter is defined further as providing an output signal indicative of an angle whose tangent is the ratio of input signals, the ratio of the first roll operational amplifier output signal to the second roll operational amplifier output signal.

10. The apparatus of claim 1 defined further to include:

means supported in the probe for measuring the dip angle ($\theta_D$) of the borehole and providing an output signal indicative of the measured dip of the borehole at a position generally near the drill bit; and wherein the means for measuring the dip angle ($\theta_D$) is defined further to include:

a dip accelerometer for measuring a component of acceleration due to gravity along the "z" axis and providing an output signal proportional to the measured component of acceleration due to gravity along the "z" axis.

11. The apparatus of claim 10 defined further to include:

means located remotely with respect to the probe for receiving the dip accelerometer output signal and providing an output signal indicative of the dip angle ($\theta_D$).

12. The apparatus of claim 11 wherein the means for receiving the dip accelerometer output signal is defined further to include:

a dip operational amplifier receiving the dip accelerometer output signal and providing an amplified output signal proportional to the dip angle ($\theta_D$).

13. The apparatus of claim 12 wherein the means for providing the output signal indicative of the dip angle ($\theta_D$) is defined further as providing a visually preceivable output signal indicating the dip angle ($\theta_D$).

14. The apparatus of claim 1 wherein the means for measuring the components of the earth's magnetic field and providing the output indication of azimuth is defined further to include:

a first azimuth operational amplifier receiving the fluxgate first output signal and providing an amplified fluxgate first output signal in response thereto; and a second azimuth operational amplifier receiving the fluxgate second output signal and providing an amplified fluxgate second output signal in response thereto, the angle converter receiving the first and second output signals provided by the fluxgate via the first and second azimuth operational amplifiers.

15. The apparatus of claim 1 wherein the means for providing the output signal indicative of the azimuth is defined further as providing a visually perceivable output signal indicating the azimuth.

16. A borehole survey apparatus adapted for use in drilling boreholes, comprising:

a fluxgate supportable within the borehole for measuring a component of the earth's magnetic field strength measured along an "x" axis extending perpendicularly to the axial centerline of the borehole and providing a first output signal proportional to the measured component of the earth's magnetic field strength generally along the "x" axis, and for measuring a component of the earth's magnetic field strength generally along a "z" axis which extends generally along the axial centerline of the probe and providing a second output signal proportional to the measured component of the earth's magnetic field strength generally along the "z" axis; and means for receiving the fluxgate first and second output signals and providing an output indication of the azimuth of the borehole at a position near the location of the fluxgate in reasponse to the first and second output signals when the "x" axis is disposed in a horizontal plane, comprising:

an angle converter receiving the first and second output signals provided by the fluxgate and providing an output signal proportional to an angle whose tangent is the quotient of the first and second output signals provided by the fluxgate, the angle converter output signal being proportional to the azimuth of the probe housing; and means for receiving the output signal provided by the angle converter and providing an output indication of the azimuth of the probe housing.

17. The borehole survey apparatus of claim 16 wherein the means receiving the fluxgate output signals is defined further to include:

a first azimuth operational amplifier receiving the fluxgate first output signal and providing an amplified fluxgate first output signal in response thereto; and a second azimuth operational amplifier receiving the fluxgate second output signal and providing an amplified fluxgate second output signal in response thereto, the angle converter receiving the first and second output signals provided by the fluxgate via the first and second azimuth operational amplifiers.

18. The borehole survey apparatus of claim 17 wherein the means for providing the output signal indicative of the azimuth is defined further as providing a visually perceivable output signal indicating the azimuth.

19. The borehole survey apparatus of claim 16 defined further to include:

a first roll accelerometer supportable within the borehole for measuring a component of acceleration due to gravity along a "y" axis, the "y" axis being generally perpendicular to the "x" "z" axes, and providing an output signal proportional to the measured component of acceleration due to gravity along the "y" axis;

a second roll accelerometer for measuring a component of acceleration due to gravity along the "x" axis and providing an output signal proportional to the measured component of acceleration due to gravity along the "x" axis; and means receiving the output signals providing by the first and the second roll accelerometers and providing an output signal proportional to the rotational orientation, the roll angle ($\theta_R$), of the first and the second roll accelerometers in the borehole.

20. The borehole survey apparatus of claim 19 wherein the first roll accelerometer is defined further as being supported to provide an output signal proportional to the cosine of the roll angle ($\theta_R$), and wherein the second roll accelerometer is defined further as being supported to provide an output signal proportional to the sine of the roll angle ($\theta_R$).

21. The borehole survey apparatus of claim 20 defined further to include:

a first roll operational amplifier receiving the first roll accelerometer output signal and providing an amplified output signal proportional to the sine of the roll angle ($\theta_R$);

a second roll operational amplifier receiving the output signal provided by the second roll accelerometer and providing an amplified output signal indicative of the cosine of the roll angle ($\theta_R$); and an angle converter receiving the first roll operational amplifier output signal and the second roll operational amplifier output signal and providing an output signal indicative of the roll angle ($\theta_R$).

22. The borehole survey apparatus of claim 21 defined further to include:

means for receiving the output signal indicative of the roll angle ($\theta_R$) and for providing a visually perceivable output signal indicative of the roll angle ($\theta_R$).

23. The borehole survey apparatus of claim 16 defined further to include:

a dip accelerometer for measuring a component of acceleration due to gravity along the "z" axis and providing an output signal proportional to the measured component of acceleration due to gravity along the "z" axis; and means for receiving the dip accelerometer output signal and providing an output signal indicative of the dip angle ($\theta_D$) of the borehole at a position generally near the dip accelerometer.

24. The borehole survey apparatus of claim 23 wherein the means for receiving the dip accelerometer output signal is defined further to include:

a dip operational amplifier receiving the dip accelerometer output signal and providing an amplified output signal proportional to the dip angle ($\theta_D$).

25. The borehole survey apparatus of claim 24 wherein the means for providing the output signal indicative of the dip angle ($\theta_D$) is defined further as providing a visually perceivable output signal indicating the dip angle ($\theta_D$).

26. A method for indicating parameters of a substantially horizontal borehole formed through an earth formation, comprising the steps of:

measuring a component of the earth's magnetic field strength measured along a "z" axis which extends generally along the axial centerline of the borehole;

providing an output signal proportional to the measured component of the earth's magnetic field strength generally along the "z" axis;

measuring a component of the earth's magnetic field strength measured along an "x" axis which extends perpendicular to the "z" axis and which extends in a generally horizontal direction;

providing an output signal proportional to the measured component of the earth's magnetic field strength generally along the "x" axis; and receiving the output signals proportional to the measured components of the earth's magnetic field strength generally along the "x" and the "z" axes and providing an output indication of the azimuth in response to the received output signals.

27. The method of claim 30 wherein the step of receiving the output signals proportional to the measured components of the earth's magnetic field strength generally along the "x"0 and the "z" axes is defined further as providing an output signal indicative of an angle whose tangent is the ratio of the input signals.

28. The method of claim 26 defined further to include the steps of:

measuring with a first roll accelerometer a component at acceleration due to gravity along one axis generally perpendicular to the axial centerline of the borehole;

providing an output signal proportional to the measured component of acceleration due to gravity along said one axis;

measuring with a second roll accelerometer a component of acceleration due to gravity along one other axis generally perpendicular to said one axis and to the axial centerline of the borehole;

providing an output signal proportional to the measured component of acceleration due to gravity along said one other axis; and receiving the output signals proportional to the components of acceleration due to gravity along said one axis and said one other axis are providing an output signal indicative of the rotational orientation of the roll accelerations, the roll angle ($\theta_R$).

29. The method of claim 28 wherein the first roll accelerometer provides an output signal proportional to the cosine of the roll angle ($\theta_R$) and wherein the second roll accelerometer provides an output signal proportional to the sine of the roll angle ($\theta_R$).

30. The method of claim 29 wherein the step of receiving the output signals proportional to the measured components of acceleration due to gravity along said one axis and said one other axis is defined further as providing an output signal indicative of an angle whose tangent is the ratio of the two received output signals.

31. The method of claim 28 defined further to include the steps of:

Measuring via a dip accelerometer a component of acceleration due to gravity along the "z" axis and providing an output signal proportional to the measured component of acceleration due to gravity along the "z" axis; and receiving the output signal of the dip accelerometer and providing an output signal indicative of the dip angle ($\theta_D$) of the borehole generally near the dip accelerometer.

32. The method of claim 31 defined further to include the steps of:

disposing the means for measuring a component of the earth's magnetic field strength measured along the "z" and the "x" axes, the dip accelerometer and the first and the second roll accelerometers generally near a drill bit drilling the borehole in an earth formation so the measured azimuth, roll angle ($\theta_R$) and dip angle ($\theta_D$) are indicative of the parameters of the borehole generally near the drill bit drilling the borehole.

* * * * *